United States Patent [19]

Nagai et al.

[11] 4,452,366

[45] Jun. 5, 1984

[54] CARGO CONTAINERS

[75] Inventors: Hideo Nagai, Utsunomiya; Fumio Koga, Yokohama, both of Japan

[73] Assignees: Fuji Jukogyo Kabushiki Kaisha, Tokyo; Nissan Jidosha Kabushiki Kaisha, Yokohama, both of Japan

[21] Appl. No.: 472,916

[22] Filed: Mar. 7, 1983

[30] Foreign Application Priority Data

Mar. 30, 1982 [JP] Japan ..... 57/51886
Mar. 30, 1982 [JP] Japan ..... 57/51887

[51] Int. Cl.[3] ..... B65D 7/24

[52] U.S. Cl. ..... 220/4 R; 220/4 F; 220/1.5; 220/76

[58] Field of Search ..... 220/4 R, 4 F, 1.5, 67, 220/75, 76

[56] References Cited

U.S. PATENT DOCUMENTS 3,306,487 2/1967 Gregoire ..... 220/1.5
3,809,278 5/1974 Csumrik ..... 220/4 F
4,020,967 5/1977 Hammond et al. ..... 220/1.5 X
4,099,640 7/1978 Nessfield et al. ..... 220/1.5 X

*Primary Examiner*—Steven M. Pollard
*Attorney, Agent, or Firm*—Martin A. Farber

[57] ABSTRACT

A weatherproof system for cargo containers has therein an outwardly open lengthwise channel or groove formed in each of two opposing side edges of a floor panel 1, and the lower portion of one of four side panels is disposed immediately outward of the groove in such a way that a water trapping chamber is defined between the lengthwise groove and the lower portion of the side panel. The bottom surface of the water trapping chamber thus defined is in substantially coplanar relationship with an adjacent seat surface which supports thereon the bottom edge of each of the side panels, and the upper wall of the water trapping chamber is extended outwardly so as to define a water drip or barrier means. Therefore, rain or sea water flowing along the intersurface between the floor panel and each of the side panels is entrapped in the water trapping chamber and consequently prevented from further flowing into the interior of the container.

6 Claims, 18 Drawing Figures

CARGO CONTAINERS

BACKGROUND OF THE INVENTION

The present invention relates generally to a cargo or freight container and more particularly to a weatherproof or waterproof system for preventing intrusion of rain or sea water along the intersurface between the floor and the side walls of the container into the interior thereof, thereby preventing loaded cargoes from becoming wet and damaged.

In general, cargo or freight containers which are transportable comprise a generally rectangular floor panel, four side panels and a roof panel. Such containers must be provided with suitable weatherproof or waterproof means so that cargoes therein are prevented from becoming wet and damaged by rain or sea water. The weatherproof systems for cargo or freight containers which are not foldable or collapsible are relatively simple in construction and easy to install, but those for foldable or collapsible containers of the type in which four side panels can be folded over the floor panel, one upon another, are complicated in construction and difficult to make fully weatherproof because the foldable or collapsible containers have many surfaces of contact between the floor, side and roof panels which are not permanently and water-tightly joined together. In the prior art foldable or collapsible containers, resilient sealing means such as rubber packings are interposed in the joints between the floor, side and roof panels when they are assembled, thereby water-tightly sealing the container.

The use of packing members is very effective in providing a weatherproof system, but it has some disadvangages or defects as will be described below. Firstly, they are much softer than the materials such as steels of the structural components, that is, the floor, side and roof panels so that in the loading and unloading of the containers, inevitable collisions with "foreign bodies" often cause puncturing of packing members with the resultant water hazard. Secondly, the service life of the packings is very short as compared with the container structural components such as floor, side and roof panels. Therefore, during a long period of use, the packing members deteriorate so that they cannot ensure desired water-tight sealing function. Accordingly, the packing members must be periodically inspected and replaced if damage is found. Therefore, in some cases, the foldable containers with cargoes loaded therein are completely covered with sheet covers so as to protect them from rain or sea water during transportation and outdoor storage.

SUMMARY OF THE INVENTION

The primary object of the present invention is therefore to provide a cargo or freight container in which the leakage or intrusion of rain or sea water through the joints between the adjacent floor, side and roof panels into the interior of the container can be substantially prevented without the use of any packing members.

To the above and other ends, the present invention provides a cargo or freight container of the type comprising a floor panel, side panels held upright with their bottom edges seated on their respective seat means disposed along the sides of the floor panel and a roof panel which covers the open top defined by said four side panel, characterized in that a lengthwisely extended, outwardly open channel or groove means is formed in at least some of the side edge parts of the floor panel so that a water trapping or containment chamber is defined by the channel or groove means and the lower portion of one of the side panels seated respectively on said some side edge parts of the floor panel; the bottom surface of the water trapping chamber is in substantially coplanar relationship with the surface of the seat means; and the upper wall of the water trapping chamber is extended outwardly toward one of the side panels so as to define a water drip or barrier means.

According to the present invention, therefore, rain or sea water which intrudes through the joints between the floor and side panels can be positively entrapped in the water trapping chambers so that the intrusion into the interior of the container of rain or sea water can be substantially prevented without use of any packing members, and consequently cargoes loaded in the container can be prevented from being wetted and damaged by water.

According to one embodiment of the present invention, water entrapped in the water trapping chambers can be discharged through water drain channel means which are communicated with the water trapping chambers.

According to another embodiment of the present invention, a jaw-like water barrier means of a predetermined length is depending from the outer side edge of the upper wall of the water trapping chamber so that water which is entrapped therein can be prevented from further flowing into the interior of the container.

According to a still another embodiment of the present invention, at least the side wall of the water trapping chamber has an inwardly concaved, partially cylindrical surface so that the water flowing into the water trapping chamber is caused to swirl therein and consequently prevented from further flowing into the interior of the container.

The above and other objects, effects and advantages of the present invention will become more apparent from the following descriptin of preferred embodiments thereof taken in conjunction with the accompanying drawings.

DETAILED DESCRIPTION OF THE INVENTION

Preferred embodiments of the present invention will now be described with reference to the accompanying drawings. In the embodiments of the invention to be described, the principle of the invention is applied to a foldable or collapsible container so that the construction of this type of container and the method of folding it will be first described for the sake of better understanding of the present invention.

Figure 1:
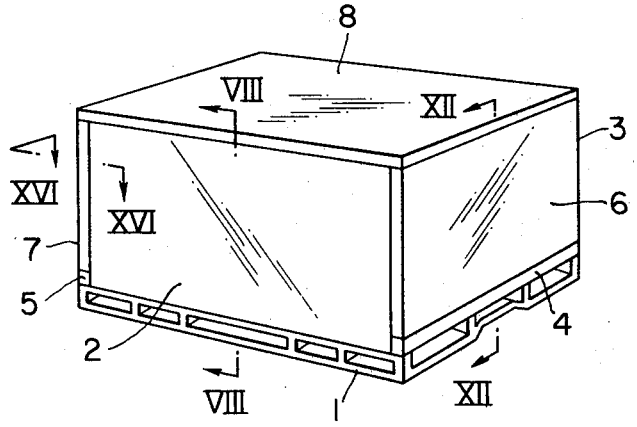
FIG. 1 is a perspective view of a foldable or collapsible container to which is applied the present invention.

In FIG. 1 is shown in perspective view a foldable container which is in the erected state. The container has a rectangular floor panel 1, a pair of opposing first side panels 2 and 3, a pair of opposing second side panels 6 and 7, and a top or roof panel 8. The first side panels 2 and 3 are held upright along the longer sides or edges of the floor panel 1, and the bottom edges of the panels 6 and 7 are pivotally attached or hingedly to the bottom base beams 4 and 5, respectively, which in turn are securely attached along the shorter sides or edges of the floor panel 1. In the erected state, both the second side panels 6 and 7 are held upright. The roof panel 8 is securely attached with suitable fastening means to the top opening defined by the first side panels 2 and 3 and the second side panels 6 and 7.

Figure 2:
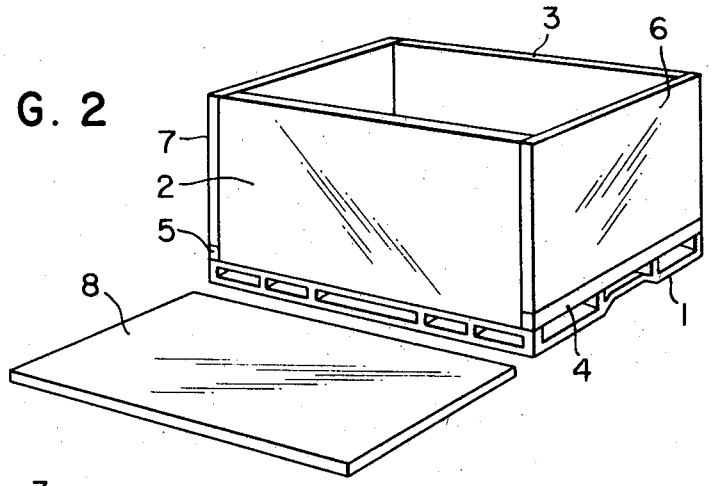
FIGS. 2 through 7 are views explanatory of successive steps of folding or collapsing the container into a flat state.
Figure 3:
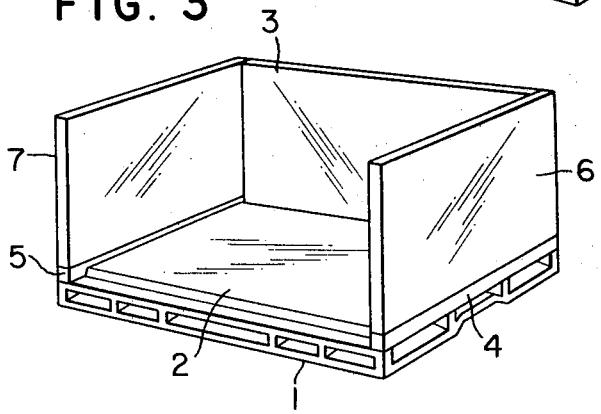
Figure 4:
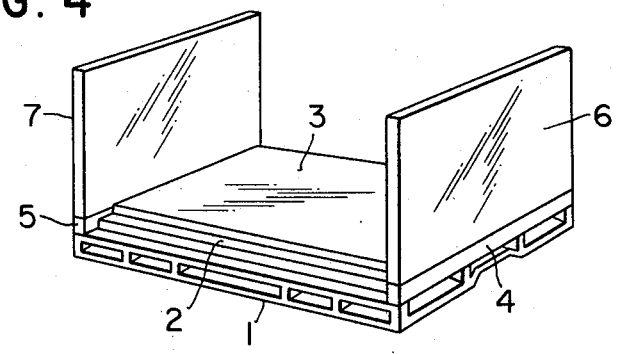
Figure 5:
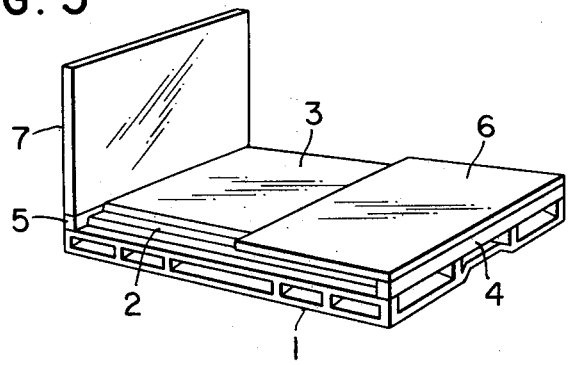
Figure 6:
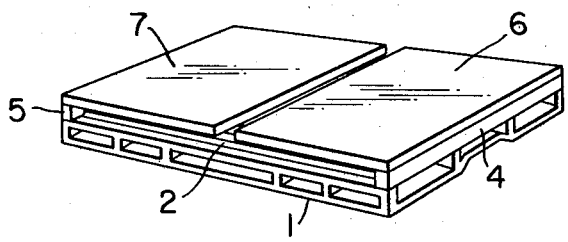
Figure 7:
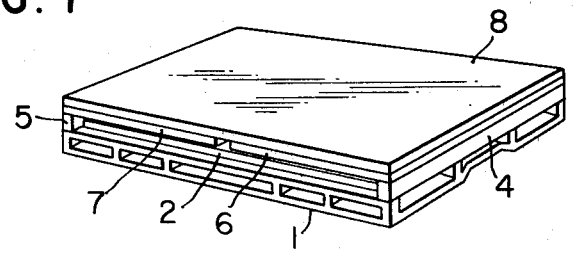

Next the mode of folding or collapsing the container will be described. First, as shown in FIG. 2, the roof panel 8 is removed and then the first side wall panel 2 is removed and overlaid over the floor panel 1 as shown in FIG. 3. In like manner, the other first side panel 3 is removed and overlaid over the side panel 2 which is overlaid over the floor panel 1 as shown in FIG. 4. Thereafter, the second side panel 6 is inwardly folded over the side panel 3 as shown in FIG. 5 and then in like manner the other second side panel 7 is folded over the side panel 3 as shown in FIG. 6. Finally, as shown in FIG. 7, the roof panel 8 is overlaid over the second side panels 6 and 7 which are folded in a horizontal position and thus the container is completely folded or collapsed.

Next, the weatherproof or waterproof system which forms a characteristic part of the present invention, and which is applied to the foldable container of the kind described above will be described in detail. First, reference is made to FIG. 8 which is a sectional view taken along the line VIII—VIII of FIG. 1. It is seen that the first side panel 2 is embossed or partially outwardly drawn in order to give it desired mechanical strength as a structural member and a desired outer appearance. The upper edge portion of the side panel 2 is welded or otherwise securely fastened to an upright leg portion or flange of an angle member 11, which is referred to as "the upper sealing frame" in this specification. The side edge portion of the roof panel 8 is securely fixed to the upper surface of a box girder 12, which is referred to as "the sealing beam" in this specification. When the container is erected as shown in FIG. 1, the bottom of the sealing beam 12 is placed into close contact with the flange portion 11*a* of the upper sealing frame 11. It is preferable that a flashing member 13 be securely fixed to the outer side wall of the sealing beam 12 and extended downwardly and slightly outwardly.

In like manner, the lower edge portion of the first side panel 2 is securely welded or otherwise fastened to an upright portion of an angle member 14, which is referred to as "the lower sealing frame" in this specification. When the container is erected, the horizontal flange portion 14*a* of the lower sealing frame 14 is seated over and placed into close contact with the bottom surface 18*a* of a side channel 15 to be described in detail hereinafter with reference to FIG. 9.

Figure 9:
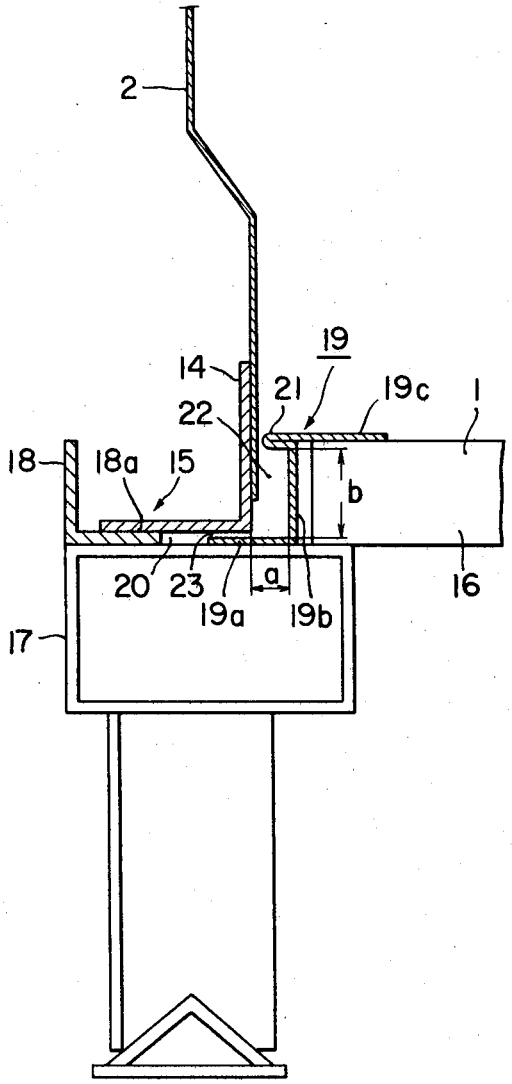
FIG. 9 is a fragmentary view, on an enlarged scale, of a part of FIG. 8, illustrating a weatherproof system of the present invention applied to the joint between a side panel and a floor panel.

Referring particularly to FIG. 9, the floor assembly shown therein comprises a corrugated floor section 16 forming the floor panel 1 and a hollow supporting beam 17 of rectangular cross section which supports the corrugated floor section 16. An angle beam 18 and a flashing or water barrier member generally designated by the reference numeral 19 are securely mounted as by welding on the top surface of the hollow supporting beam 17 in such a way that the horizontal portions of both the beams 18 and 19 are spaced apart from each other by a suitable distance, and consequently a water drain channel 20 is defined. The thus defined water drain channel 20 is communicated with a water drain outlet (not shown).

The one-piece flashing frame 19 can be fabricated from a single blank sheet by a stamping press so that it has a lower horizontal portion 19*a*, a vertical or upright portion 19*b* and an upper horizontal portion 19*c*. The upper horizontal portion 19*c* is first bent so as to extend transversely outwardly by a suitable length and then folded back over the transversely outwardly extended portion and the floor plate 1 so that a water drip portion or water barrier 21 is provided. Therefore, the barrier portion 21 is partially extended into the side channel 15. The thus fabricated water barrier member 19 is securely fitted into water-tight contact with the side edge portion of the floor section 16.

When the lower sealing frame 14 of the side panel 2 is inserted into the side channel 15 and seated over the horizontal portion 18*a* of the angle beam 18, a water trapping chamber 22 defined by the side panel 2, and the lower horizontal portion 19*a*, the upright portion 19*b* and the barrier portion 21 of the water barrier frame 19. The volume or capacity of the water trapping chamber 22 can be arbitrarily adjusted by suitably selecting the distance a between the upright portion 19*b* of the water barrier frame 19 and the side panel 2 or its lower water sealing frame 14 and the height b of the upright portion 19*b*. Stated in another way, the volume of the water trapping chamber 22 is determined according to the expected amount of water leaking into the container. The water trapping chamber 22 is communicated with the water drain channel 20 through a passage 23 defined between the horizontal portion 14*a* of the lower sealing frame 14 of the side panel 2 and the lower horizontal portion 19*a* of the water barrier frame 19 so that water entrapped in the water trapping chamber 22 flows through the passage 23 and the water drain channel 20 longitudinally thereof to the exterior of the container.

Figure 10:
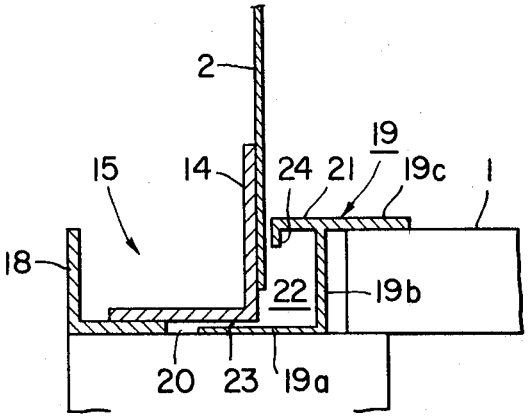
FIG. 10 and FIG. 11 are views similar to FIG. 9 but illustrating second and third embodiments, respectively, of the present invention.

According to a second embodiment of the present invention shown in FIG. 10, a jaw-like member or flange 24 is extended downwardly from the outer edge of the barrier portion 21 of the frame 19 so that the water which flows into the water trapping chamber 22 is prevented from further flowing or intruding into the interior of the container.

Figure 11:
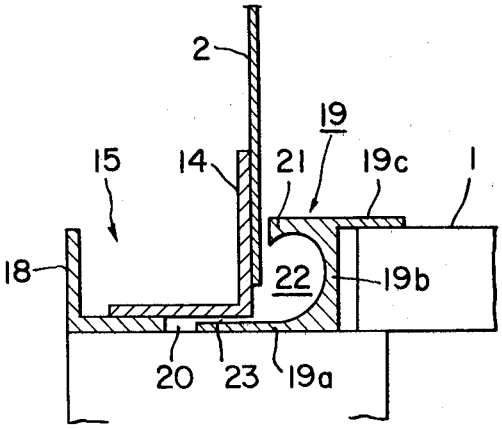

According to a third embodiment as shown in FIG. 11, the outer surfaces of the part of the lower horizontal portion 19*a*, the upright portion 19*b* and the barrier portion 21 are smoothly and arcuately curved so that the water trapping chamber 22 has a partially circular cross sectional configuration. Therefore, the water which is forced to flow from the side channel 15 through the passage 23 into the water trapping chamber 22 is swirled along the smoothly curved surface of the chamber 22 so that the water can be positively trapped in the water trapping chamber 22 and prevented from further flowing into the interior of the container.

Next referring to FIG. 12, the weatherproof system between the second side panel 6 or 7 and the roof panel 8 and the floor panel 1 will be described in detail. Since the weatherproof systems for the two side panels 6 and 7 are substantially similar in construction, it will suffice to describe only the weatherproof system for the side wall panel 6. The upper end portion of the panel 6 is securely welded or otherwise fastened to the upright flange portion of an angle member or an upper sealing frame 26 as in the case of the first side panel 2 or 3. The edge portion of the roof panel 8 is rigidly welded or otherwise secured to the upper surface of a box girder or a hollow sealing beam 27. Therefore, when the container is erected, the bottom of the sealing beam 27 is mounted on and placed into water-tight contact with the horizontal flange portion 26*a* of the sealing frame 26, whereby leakage of rain or sea water into the interior of the container can be prevented. A downwardly directed or depending flashing member 28 is also securely welded or otherwise fastened to the outer wall surface of the sealing beam 27.

The lower portion of the side panel 6 is rigidly welded or otherwise secured to the upper vertical portion 29*b* of a lower sealing frame 29 of Z-shaped cross section which is further comprised of a horizontal portion 29*a* and a lower vertical portion 29*c* which acts as a flashing or water sealing means and depends along the outer wall surface of the box-shaped base beam 4 a predetermined length. The underside surface of the horizontal portion 29*a* of the lower sealing frame 29 and the top surface of the base beam 4 are interconnected to each other so that the side panel 6 is swingably inwardly folded about a pivot pin 9 over the floor panel 1 or corrugated floor section 16 as described before with reference to FIG. 6. It is preferable that an upstanding flashing member 30 be extended interiorly of the lower vertical portion 29*c* from the outer edge portion of the top surface of the base beam 4 so that rain or sea water which flows through the space between the outer wall surface of the base beam 4 and the lower vertical portion 29*c* of the lower sealing frame 29 can be prevented by the upstanding flashing member 30 from further flowing or leaking into the interior of the container.

Figure 13:
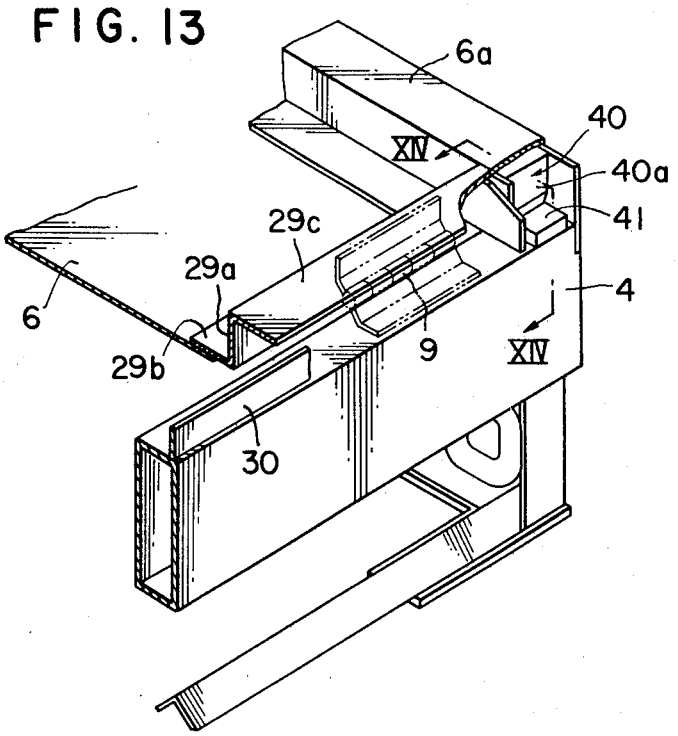
FIG. 13 is a fragmentary perspective view illustrating the lower part of FIG. 12.
Figure 14:
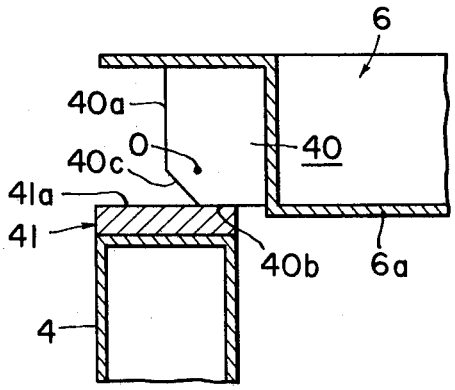
FIG. 14 is a section taken along the line XIV—XIV of FIG. 13.
Figure 15:
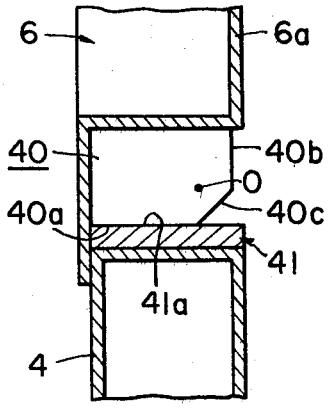
FIG. 15 is a view similar to FIG. 14 but showing a different state.

As illustrated in FIG. 13, the side panel 6 may be provided on the lower edge thereof with a load bearing block 40 which may be fixedly secured to the lower end of each of side frame members 6*a* of the side panel 6. The load bearing block 40 is formed with two abutment surfaces 40*a* and 40*b* as well as a beveled surface 40*c* as shown in FIG. 14. The base beam 4 has a seat member 41 secured on the top thereof and having a supporting surface 41*a*. In the state of FIGS. 13 and 14 wherein the side panel 6 is folded or pivoted to its horizontal position around the axis 0 of the pivot pin 9, the abutment surface 40*b* of the bearing block 40 abuts against the supporting surface 41*a* of the seat member 41, thus preventing further pivotal movement of the side panel 6, while, when the panel 6 is erected as shown in FIG. 15, the abutment surface 40*a* of the bearing block 40 abuts against the supporting surface 41*a* and the block 40 functions as a load bearing member between the base beam 4 and the side panel 6, thus preventing the entire weight of the side panel 6 from being imposed to the pivot pin 9.

Next referring to FIG. 16, the weatherproof system between the first side panels 2 and 3 on the one hand and the second side panels 6 and 7 on the other hand will be described in detail. Four corner weatherproof systems are substantially similar in construction. Therefore, it will suffice to describe only the weatherproof system between the first side panel 2 and the second side panel 7. The edge portion of the side panel 2 is rigidly welded or otherwise fastened to an inner flange portion 31*b* of a side sealing frame 31 which is further comprised of a web or intermediate portion 31*a* and an outer flange portion 31*c* which acts as water sealing means.

A corner post or structure generally designated by the reference numeral 32 has a substantially square cross sectional configuration with an inwardly extended flange portion 32*a* and longitudinally or lengthwise extended flange portion 32*c* which acts as a flashing or water sealing means. The corner post or structure 32 is made of a resiliently yieldable or flexible material so that especially the outer side wall portion 32*b* thereof becomes resiliently yieldable for a purpose to be described hereinafter.

The side edge portion of the second side panel 7 is rigidly welded or otherwise fastened to the inwardly extended flange portion 32*a* of the corner post or structure 32. One end of an L-shaped stop or retaining member 33 is securely fixed to the lengthwise extended flange portion 32*c* of the corner post or structure 32 while the other end thereof, to a rearwardly inclined wall portion 32*d* of the corner post or structure 32 in such a manner that the L-shaped retaining member 33 is engageable with a hook member 34 when the container is erected. That is, when the container is erected from the folded state, the second side panels 6 and 7 are first held upright and spaced apart from each other by a predetermined length; that is, a length almost equal to that of the first side panels 2 and 3. Thereafter, the side panels 2 and 3 are dropped into the side channels 15 (see FIG. 8 or 9). In this case, the hook members 34 of the first side panels 2 and 3 are engaged with the corresponding retaining members 33 of the corner posts or structures 32, whereby the first side panels 2 and 3 and the second side panels 6 and 7 are securely assembled together.

Figure 17:
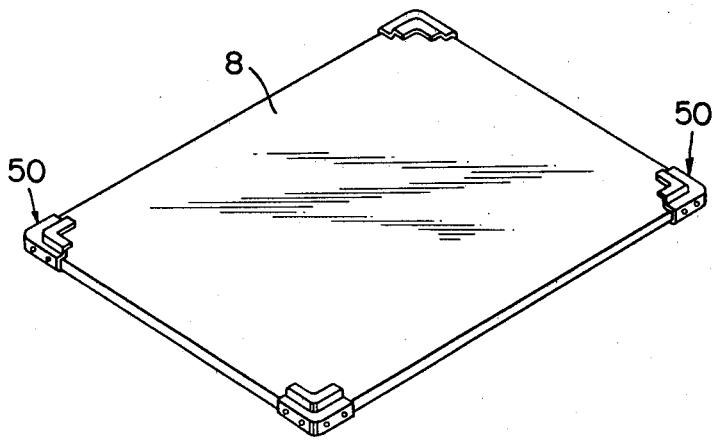
FIG. 17 shows, in perspective, a roof panel fitted with corner members.
Figure 18:
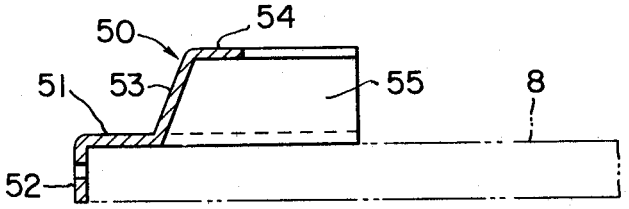
FIG. 18 is a cross section, on an enlarged scale, of the corner member.

As indicated in FIG. 17, the roof panel 8 may be fixed on its four corners with corner member 50, respectively. The corner members 50 serve as seats for receiving thereon respective bottom corner legs of another container to be placed thereon in stack as well as handles for manual handling of the container. Each corner member 50 is L-shaped in plan view and, as illustrated in FIG. 18, comprises a base portion 51 with a depending flange 52, a side wall 53 extending obliquely upward, and a top flange 54 extending horizontally, whereby when the corner member 50 is fixed to the roof panel 8 as by welding, bolting or the like, a cavity 55 in which the fingers can be inserted for handling is formed.

Next, the method for erecting the container with the above-described weatherproof system of the present invention will be described. First, as described above, the second side panels 6 and 7 are outwardly swung about the pivot pins 9 so that they are held upright. Prior to this operation, the roof panel 8 and the first side panels 2 and 3 are of course removed from their folded positions. Thereafter, the side panels 2 and 3 are vertically dropped into the side channels 15. In this case, the outer flange or sealing portion 31*c* of the side sealing frame 31 (see FIG. 16) snugly engages with the mating resiliently yieldable outside wall portion 32*b* of the corner structure 32 and the hook members 34 of the side panel 2 engage with the respective mating retaining members 33 of the corner post or structure 32. Thus, the container with the open top is assembled. Thereafter, the roof panel 8 is placed to close the top opening. In this case, the bottoms of the sealing beams 12 and 27 are mounted on, and placed into substantially water tight engagement with the horizontal flange portions 11*a* and 26*a*, respectively, of the upper sealing frames 11 and 26. Thereafter, the roof panel 8 is securely fastened to the side panels 2, 3, 6 and 7 with suitable fastening means (not shown). Thus, the container with the cargoes loaded is ready for shipment.

Figure 8:
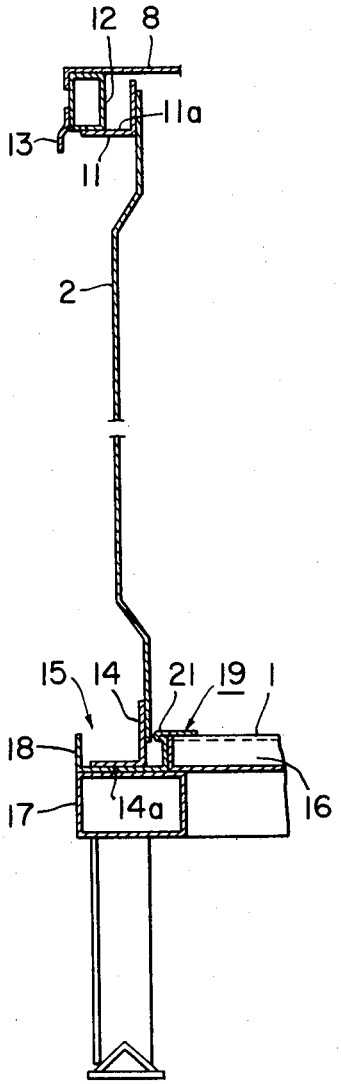
FIG. 8 is a section taken along the line VIII—VIII of FIG. 1.
Figure 12:
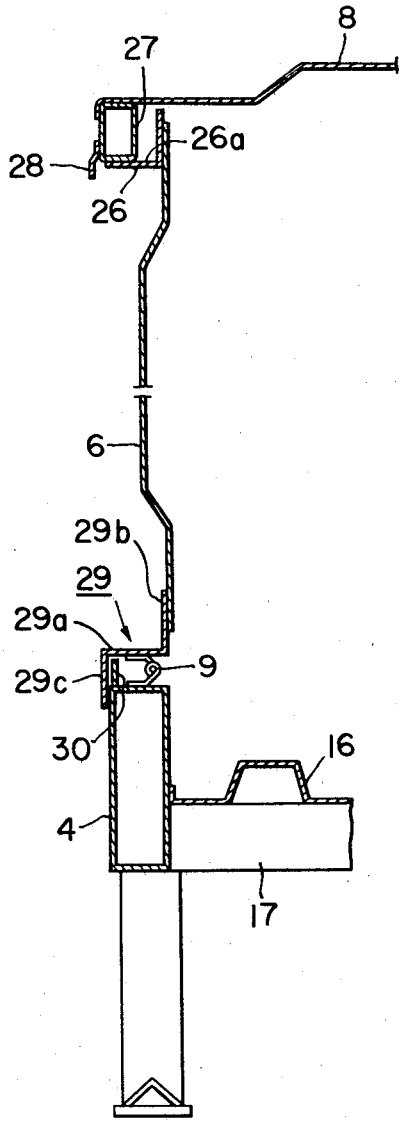
FIG. 12 is a section taken along the line XII—XII of FIG. 1.

If rain falls while the thus assembled and cargo-loaded container is being transported or stored outdoors, for instance, in a container yard, rain drops impinging on the roof panel 8 flow along it and drop along the flashing members 13 and 28 (see FIGS. 8 and 12). Since, as described above, the bottoms of the sealing beam 12 and 27 are made into intimate or water-tight contact with the horizontal flange portions 11*a* and 26*a* of the upper sealing frames 11 and 26, the intrusion of rain water along the intersurfaces between them into the interior of the container can be substantially prevented.

Rain water also flows down along the outer surfaces of the second side panels 6 and 7, are redirected outwardly by the lower sealing frames 29 (see FIG. 12), and then further flow downward along the outer surfaces of the lower vertical or sealing portions 29*c*. Even if the rain drops intrude into the space between the lower vertical or sealing portion 29*c* of the lower sealing frame 29 and the base beam 4, the upstanding flashing or water barrier 30 prevents them from further intruding into the interior or the container.

Rain drops impinging against the first side panels 2 and 3 flow down along them and drop into the side channels 15 (see FIG. 8 or 9). The rain water received in the side channels 15 is mostly discharged from their ends. Some rain water which flows along the intersurface between the horizontal flange portion 14*a* of the lower sealing frame 14 and the horizontal flange portion or seat 18*a* of the angle member 18 is received in the water drain channel 20 and is discharged from their outlets. However, in the case of heavy rain, the amount of rain water flowing into the water drain channel 20 becomes in excess of the amount of water discharged therefrom so that the excessive rain water flows through the passage 23 between the horizontal portion 14*a* of the lower sealing frame 14 and the horizontal flange portion 19*a* of the water barrier frame 19 into the water trapping chamber 22 (see FIG. 9) and is entrapped therein. Since the water drip portion 21 is extended over the water trapping chamber 21, the water can be positively prevented from further flowing from the water trapping chamber 22 into the interior of the container. The rain water entrapped in the water trapping chamber 22 is gradually discharged through the passage 23 and the water drain channel 20 as described hereinbefore.

Figure 16:
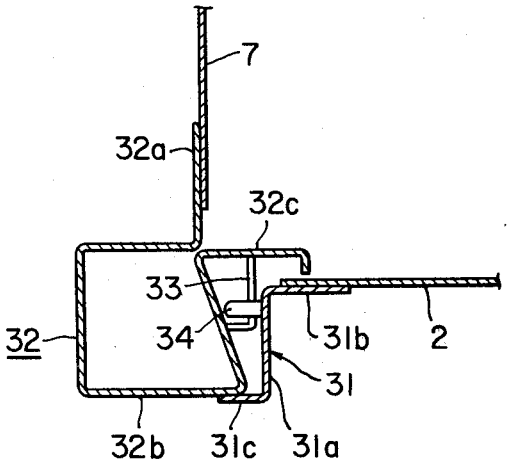
FIG. 16 is a section taken along the line XVI—XVI of FIG. 1, and illustrating a weatherproof system applied to the joint between a first side panel and a second side panel.

Referring particularly to FIG. 16, the rain drops impinging against each of the corner posts or structures 32 flow down along its outer surfaces. Since the outer wall portion 32*b* of the corner post or structure 32 is resiliently pressed against the outer flange portion 31*c* of the Z-shaped side sealing frame 31, leakage of rain water along their interface into the interior of the container can be prevented.

Although the invention has been described hereinbefore in connection with a foldable or collapsible container, it can be applied equally to non-collapsible containers having fixed side walls and roof wherein a door is provided in at least one of the side walls. In this case, the water trapping chamber is defined partly by the lower portion of the door.

What is claimed is:

1. A cargo container comprising: floor means having seat means formed along at least some of side edges thereof; upright side panel means having bottom edges, respectively, at least some of the bottom edges being seated respectively on said seat means to form a box-shaped container chamber with the top opened; roof means closing the top; and means forming a water trapping chamber along each of said some side edges of the floor means, said chamber extending lengthwise of each side edge and opening outwardly, said chamber being closed substantially by the lower portion of one of the side panel means which is disposed immediately outward of the chamber, and having a bottom surface in substantially coplanar relationship with one of the seat means, said chamber having a top surface extending outwardly and transversely to the chamber to form a water barrier means.

2. A cargo container as claimed in claim 1, further comprising a jaw-like means projecting dependingly from the outer edge of said water barrier means.

3. A cargo container as claimed in claim 1, wherein said wall trapping chamber has an inner side wall, at least the inner side wall having an inwardly concave, partially cylindrical surface.

4. A cargo container as claimed in claim 1, further comprising a sealing frame securely joined to the bottom edge portion of each of said side panel means and placed into intimate contact with the associated seat means.

5. A cargo container as claimed in claim 1, further comprising an upper sealing frame securely joined to the upper edge portion of each of the side panel means, and a sealing beam securely attached to the roof means along each of the side edges thereof and placed into intimate contact at the bottom thereof with an upwardly directed surface of the upper sealing frame.

6. A cargo container as claimed in claim 1, further comprising a sealing frame securely joined to each of the side edges of each of the two opposing side panel means forming a first pair, and a resiliently yieldable corner post means securely joined to each of the side edges of each of the other two opposing side panel means forming a second pair, said sealing frame and said corner post means being partially overlapped and resiliently pressed against each other.

* * * * *